US005785773A

United States Patent [19]

Zylla

[11] Patent Number: 5,785,773

[45] Date of Patent: Jul. 28, 1998

[54] PROCESS FOR AVOIDING STICKERS IN THE ANNEALING OF COLD STRIP

[75] Inventor: Peter Zylla, Krefeld, Germany

[73] Assignee: Messer Griesheim-GmbH, Germany

[21] Appl. No.: 699,925

[22] Filed: Aug. 20, 1996

[30] Foreign Application Priority Data

Aug. 26, 1995 [DE] Germany ..... 195 31 447.6

[51] Int. Cl.[6] ..... C21D 9/663

[52] U.S. Cl. ..... 148/634; 148/596; 148/703

[58] Field of Search ..... 148/596, 634, 148/708

[56] References Cited

U.S. PATENT DOCUMENTS 5,344,509 9/1994 Zylla .

FOREIGN PATENT DOCUMENTS 42 07 394 3/1992 Germany .
A-0 560 172 3/1993 Germany .

OTHER PUBLICATIONS

Iron and Steel Engineer, Bd. 67, Marz 1990, Pittsburgh, US, Seiten 25–29, XP000141232 R.A. Enghofer et al.: "Experience with 100% hydrogen . . . ".

Stahl und Eisen, Bd. 109, Nr. 4, 27. Feb. 1989, Dusseldorf, DE, Seiten 178–184, XP002016935 O. Pawelski et al.: "Entstenhung von Bandklebern . . . ".

*Primary Examiner*—Deborah Yee
*Attorney, Agent, or Firm*—Connolly & Hutz

[57] ABSTRACT

When cold strip is annealed, diffusion welds, so-called stickers, frequently form on the strip surface. In order to avoid these, the cold strip, above 600° C. (holding time) is coated by oxidation with a thin surface film which prevents the sticking together. Below 600° C., during the cooling phase, this surface film is removed again by reduction. In the case of a protective gas comprising a hydrogen content greater than 5%, remainder nitrogen, carbon dioxide is preferably added as oxidizing agent. The process is controlled via a defined oxygen partial pressure. The reduction is performed via the hydrogen.

8 Claims, 3 Drawing Sheets

Changes in the gas composition after heating for the homogeneous water gas reaction

| T°C | CO % | $CO_2$% | $H_2$ % | $H_2O$ % | Kp |
|---|---|---|---|---|---|
| 100 | 0.06 | 0.94 | 4.94 | 0.06 | 0.00094 |
| 200 | 0.18 | 0.82 | 4.82 | 0.18 | 0.00881 |
| 300 | 0.34 | 0.66 | 4.66 | 0.34 | 0.03789 |
| 400 | 0.49 | 0.51 | 4.51 | 0.49 | 0.10562 |
| 500 | 0.62 | 0.38 | 4.38 | 0.62 | 0.22583 |
| 600 | 0.71 | 0.29 | 4.29 | 0.71 | 0.40571 |
| 700 | 0.78 | 0.22 | 4.22 | 0.78 | 0.64618 |

Changes in the gas composition after heating for the homogeneous water gas reaction

| T°C | CO % | $CO_2$% | $H_2$ % | $H_2O$ % | Kp |
|---|---|---|---|---|---|
| 100 | 0.76 | 6.64 | 91.84 | 0.76 | 0.00094 |
| 200 | 2.06 | 5.34 | 90.54 | 2.06 | 0.0088 |
| 300 | 3.59 | 3.81 | 89.01 | 3.59 | 0.038 |
| 400 | 4.79 | 2.61 | 87.81 | 4.79 | 0.1 |
| 500 | 5.6 | 1.8 | 87 | 5.6 | 0.2 |
| 600 | 6.26 | 1.14 | 86.34 | 6.27 | 0.4 |
| 700 | 6.62 | 0.78 | 85.98 | 6.62 | 0.65 |

Starting Mixture: 92.6% $H_2$; 7.4% $CO_2$; 0.004 $H_2O$

PROCESS FOR AVOIDING STICKERS IN THE ANNEALING OF COLD STRIP

The invention relates to a process for avoiding stickers in the annealing of cold strip.

Cold strip is annealed in the form of tight coils in pot furnaces, bell-type furnaces or roller conveyor furnaces. In the recrystallization annealing in closed furnaces, such as bell-type furnaces, in particular high-convection furnaces, diffusion welds, so-called strip stickers, are frequently formed between the turns of the cold strip. In the temper rolling mill, these increase the resistance to unwinding, as a result of which buckles or material cracks form on the strip surface.

DE 42 07 394 C1 describes a process for avoiding these trip stickers. According to this process, the surface of the cold strip wound up to form tight coils is coated above 600° C. by means of defined oxidation processes with a thin surface film which prevents the sticking of the turns. During the cooling phase, below 600° C., this surface film is removed again by reducing the oxides. This is performed by changing the water gas equilibrium. The entire annealing process takes place in an annealing furnace, in particular a bell-type furnace, under an $N_2$—$H_2$ protective gas mixture containing at most 5% of $H_2$ and with addition of defined amounts of $CO_2$. The entire reaction process is assigned to the water gas reaction $$H_2+CO_2=CO+H_2O.$$

The reaction between hydrogen and carbon dioxide causes intensive steam formation which is a function of the thermodynamic state of the system. This is favored by a high $H_2$ or $CO_2$ concentration and high temperatures. Table 2 and FIG. 2 show, for example, the temperature-dependent change in concentration in a starting mixture of 5% $H_2$ and 1% $CO_2$. The $H_2O$ and CO curves coincide. The temperature is plotted on the x axis and the concentration of the gas components is plotted on the y axis. Steam formation increases with increasing temperature. At 700° C., these values are still below 1% by volume. Increasing the $CO_2$ concentration in the starting mixture increases the steam formation up to approximately 2% by volume. The amount of $CO_2$ is fixed and depends on the surface area of annealing material treated. An appropriately oxidizing ratio of the $CO_2$ and CO partial pressures is achieved by changing the steady-state equilibrium of the water gas reaction. This is achieved by a higher throughput of the protective gas.

A protective gas having a hydrogen content of 92.6% is described in Table 3, FIG. 3. As a comparison between Table 3 and Table 2 shows, at $H_2$ contents >5%, unreasonable steam concentrations of up to approximately 6.6% by volume (at 700° C.) are formed. The appropriately oxidizing $CO_2$—CO ratio is not achieved in any temperature range. At high $CO_2$ concentrations, the oxidation proceeds in an uncontrolled manner in the $H_2$—$H_2O$ system at low, therefore undesired, temperatures, in which case the possibility of a subsequent reduction of the strip surface is not provided. These results listed in Table 3 have been clearly confirmed in studies carried out in the laboratory. An admixture of 5 to 10% by volume of $CO_2$ to the hydrogen at treatment temperatures of 680° C. caused formation of water to such a great extent that these studies had to be terminated in order to prevent destruction of the analytical instruments. The content of hydrogen in the protective gas in sticker-free annealing of cold strip is therefore restricted to a maximum of 5% by volume in DE 42 07 374 C1.

Strip stickers further occur when cold strip is treated in high-convection furnaces under protective gases containing >5% hydrogen. A process for annealing cold strip would therefore be desirable by means of which strip stickers could be avoided even when protective gases containing up to 100% $H_2$ are used.

SUMMARY OF INVENTION

The object underlying the invention is to provide a process for avoiding strip stickers during the annealing of cold strip under protective gases having a hydrogen content >5%.

In accordance with this invention stickers are avoided in the annealing of cold strip in a bell-type furnace preferably using high convection under a protective gas comprising >5% to 100% hydrogen with the remainder being nitrogen. The cold strip is coated during the holding time with a thin surface film by oxidation at temperatures above 600° C. by establishing a particular oxidizing pressure ratio, by the admixture of 0.3 g to 0.6 g of carbon dioxide $m^2$ of annealing material surface to the protective gas and high disruption of the thermodynamic equilibrium of the homogeneous water gas reactions.

THE DRAWINGS

DETAILED DESCRIPTION

Only by means of the surface film formed by the process of the invention is protection achieved from the sticking together of individual turns of the cold strip under a protective gas having a hydrogen content greater than 5%, preferably having a hydrogen content greater than 70%, in particular 100%. The prerequisite therefor is extremely high disruption of the thermodynamic equilibrium of the homogeneous water gas reaction. This means virtually suppressing the course of the reaction as described by $H_2+CO_2=CO+H_2O$. Test operations with approximately 60 t annealing batches have surprisingly shown that cold strip can be coated with a surface layer, and thus can be treated so as to be sticker-free, in closed furnaces, for example in bell-type furnaces, with high convection even under protective gas containing 100% $H_2$ with addition of $CO_2$.

By means of high output of the circulation fans used in high-convection furnaces, the flow velocities of the circulated $H_2$ protective gas at temperatures of 600° to 750° C. are so high that the homogeneous water gas reaction can scarcely still take place and the steady-state equilibrium departs very greatly from the thermodynamic equilibrium. According to the invention, steady-state equilibria of K<<0.01 are employed here. Steady-state equilibrium is taken to mean here an actual state which is calculated mathematically by the formula below on the basis of analysis of the gas composition:

$$K=\frac{PCO\ PH_2O}{PH_2\ PCO_2}$$

The quotient K becomes <<0.01 only when the divisor is very large and the dividend is very small, which denotes a virtual cessation of the reaction. By this means, it surprisingly becomes possible to achieve an oxidizing partial pressure ratio (P) of carbon dioxide ($CO_2$)/carbon monoxide (CO). Steam formation in this case is greatly restricted.

The homogeneous water gas reaction is in this case unusable for controlling the process of the invention. It is controlled rather via the dissociation of the admixed defined amount of $CO_2$ as described by:

$$CO_2=CO+0.5\ O_2.$$

An oxygen partial pressure resulting from this reaction is set as required in the protective gas atmosphere. The process of coating the strip surface with a surface film which prevents the sticking of the turns is carried out under a defined $O_2$ partial pressure. This can be defined as the quotient of the partial pressures (P) of $CO_2$ and CO and must not be less than 1 in the oxidation process above 600° C.

Figure 1:
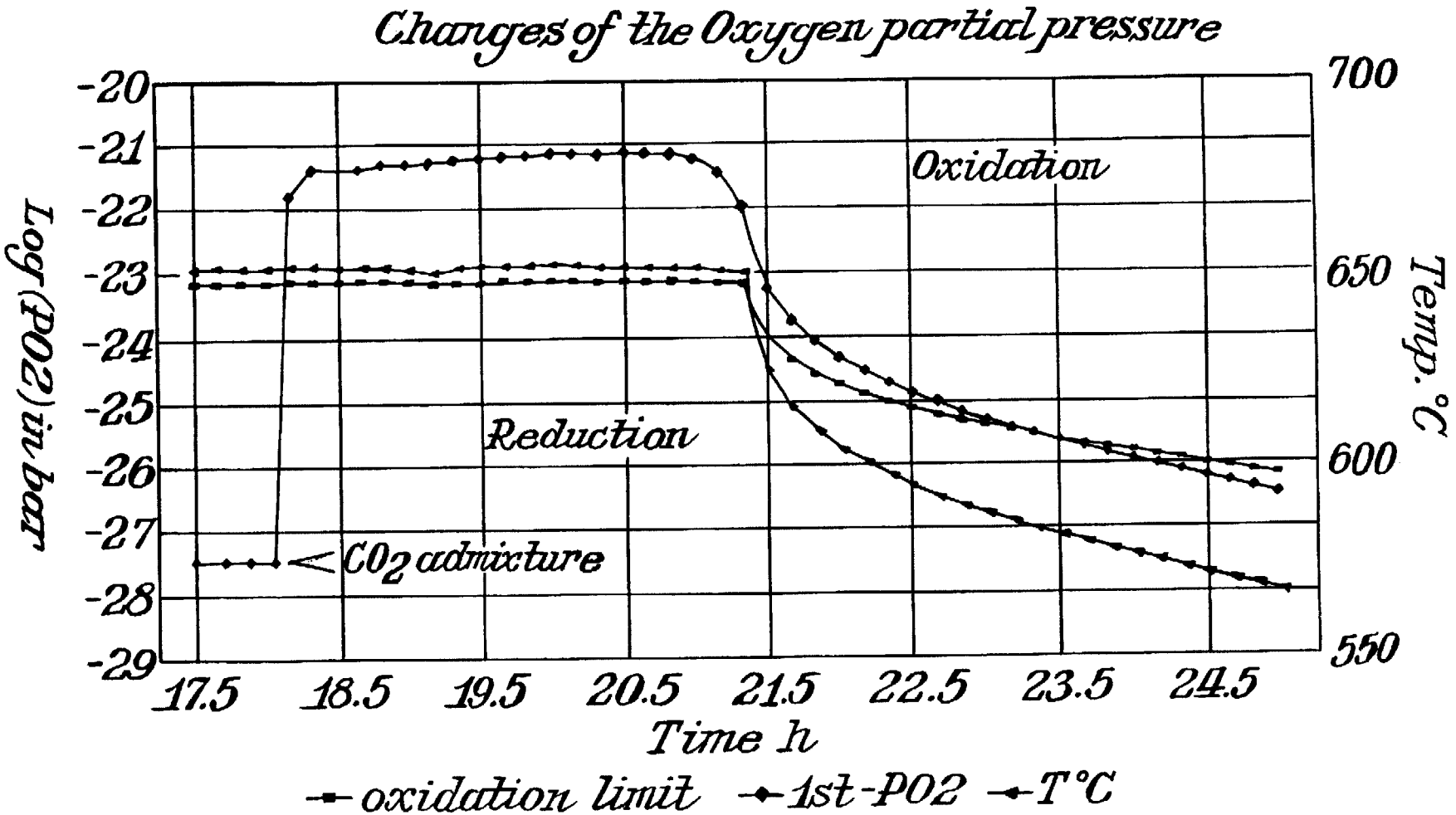
FIG. 1 is a graph showing changes of the oxygen partial pressure.
Figures 2A, 2B:
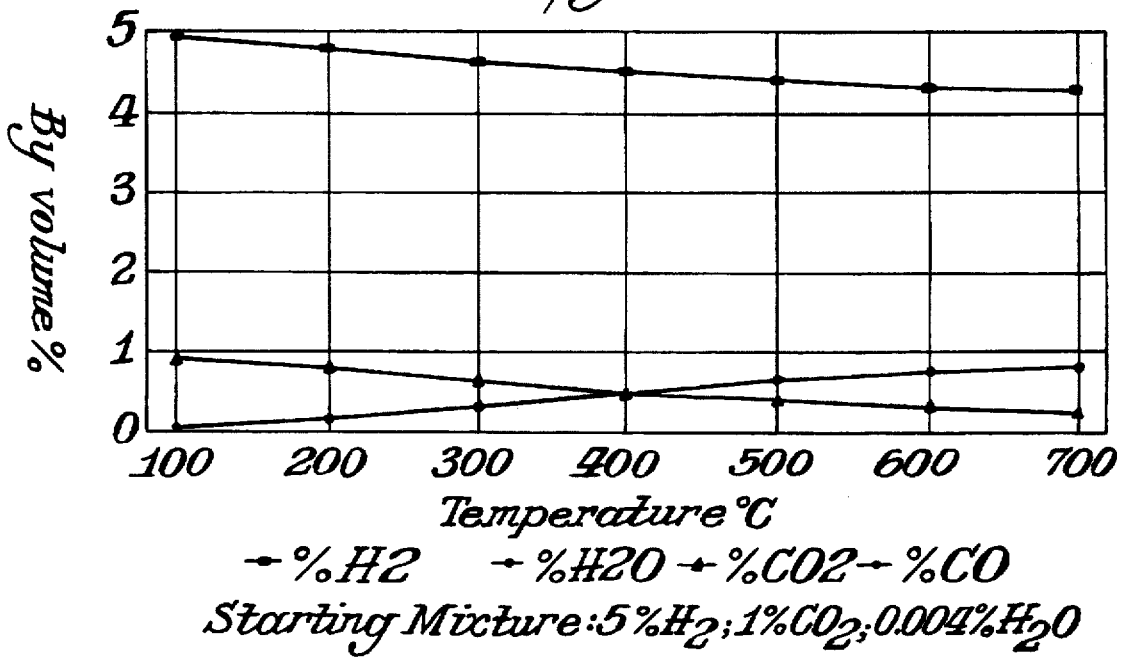
FIG. 2 are a table and graph showing changes in the gas composition after heating for the homogeneous water gas reaction.
Figures 3A, 3B:
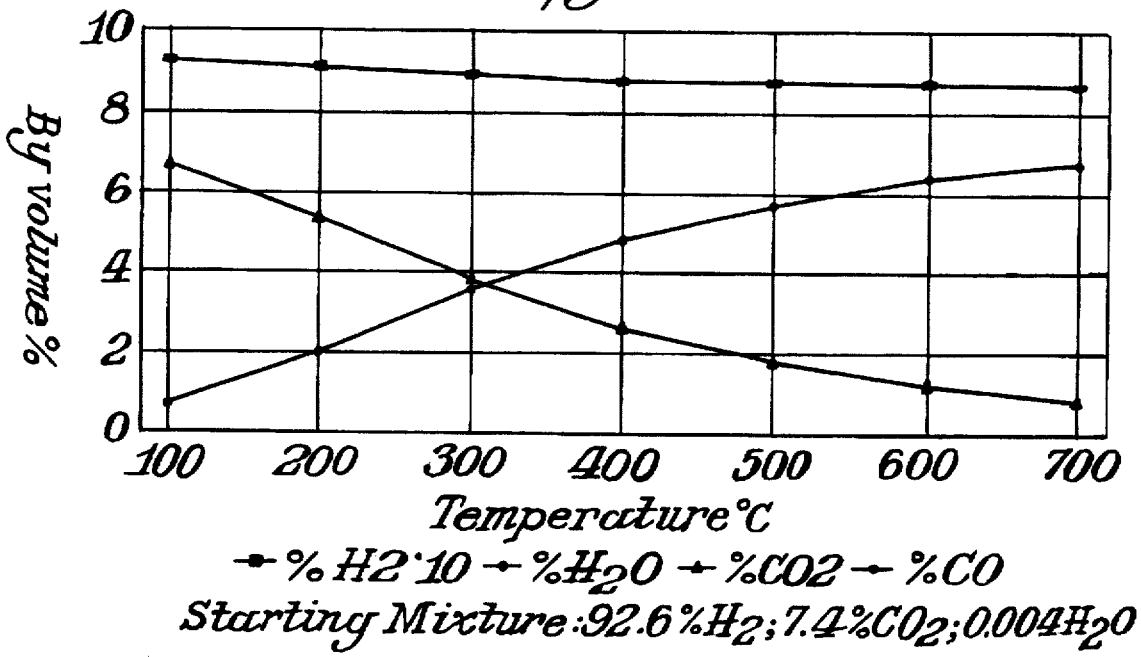
FIG. 3 are a table and graph showing changes in the gas composition after heating for the homogeneous water gas reaction.

FIG. 1 shows graphically the changes in the oxygen partial pressure ($PO_2$). In this figure, $PO_2$ is shown as a logarithmic function of temperature and time. The $CO_2$ admixture phase can clearly be seen. This is terminated at the start of the cooling phase. Surface films built up in this way with an amount of $CO_2$ of 0.3 to 0.6 g per $m^2$ of annealing material surface prevent the sticking of individual turns in the coil. A high reducing power of the hydrogen in the cooling phase ensures the breakdown of this surface film below 600° C.

During the holding time in pure hydrogen atmospheres, intense methane formation takes place because $H_2$ reacts with the carbon originating as a cracking product from the volatilization phase (heating) in accordance with the equation $H_2+C=CH_4$.

Methane contents higher than about 2% by volume have an adverse effect on the establishment of the required oxygen partial pressure which is critical for the coating with a protective surface film. The admixed $CO_2$ then reacts with methane in accordance with the following reaction:

$$CH_4+CO_2=2H_2+2CO.$$

The carbon dioxide is thus broken down and new CO forms to such an extent that the ratio of the partial pressures (P)

$$P(CO_2)/P(CO)<1$$

is established and as a result of this a defined coating of the strip surface with a protective surface film is not possible, or not possible economically.

In order to carry out the proposed coating process free from interference, the methane content in the last phase of the holding time, prior to the $CO_2$ admixture, must not exceed a concentration of approximately 2% by volume of the protective gas atmosphere. If low-carbon and carburization-sensitive steels are treated by the process of the invention, e.g. titan microalloy IF steel (special deep-draw steel), it is necessary to decrease the C level of the protective gas atmosphere to 0.003%.

What is claimed is:

1. A process for avoiding stickers in the annealing of cold strip in a bell-type furnace under a protective gas comprising >5% to 100% by volume of hydrogen, remainder nitrogen, including the phases heating, holding and cooling, which comprises coating the cold strip during the holding time with a thin surface film by oxidation at temperatures above 600° C., by establishing an oxidizing partial pressure ratio $$P(CO_2)/P(CO)>1$$

by admixture of 0.3 g to 0.6 g of carbon dioxide per $m^2$ of annealing material surface to the protective gas and high disruption of the thermodynamic equilibrium of the homogeneous water gas reactions (K <<0.01).

2. The process as claimed in claim 1, wherein, during the cooling phase at temperatures below 600° C., a partial pressure ratio of $$P(CO_2)/P(CO)<1$$

is established for reduction of the surface film.

3. The process as claimed in claim 2, wherein the steam content in the protective gas is set below 1.5% by volume during the $CO_2$ admixture and the surface is reduced by hydrogen during the cooling phase.

4. The process as claimed in claim 3, wherein the methane content in the protective gas is set below 2% by volume prior to the $CO_2$ admixture.

5. The process as claimed in claim 2, wherein the methane content in the protective gas is set below 2% by volume prior to the $CO_2$ admixture.

6. The process as claimed in claim 1, wherein the methane content in the protective gas is set below 2% by volume prior to the $CO_2$ admixture.

7. The process as claimed in claim 1, wherein the steam content in the protective gas is set below 1.5% by volume during the $CO_2$ admixture and the surface is reduced by hydrogen during the cooling phase.

8. The process as claimed in claim 1, wherein the furnace is a high convection furnace.

* * * * *